United States Patent [19]

Condit

[11] 4,078,265

[45] Mar. 14, 1978

[54] REVERSIBLE ATHLETIC JERSEY

[76] Inventor: Teresa Helena Condit, 4125 Simpson Ave., Cincinnati, Ohio 45227

[21] Appl. No.: 756,411

[22] Filed: Jan. 3, 1977

[51] Int. Cl.[2] ..... A41B 1/00; G09F 11/02

[52] U.S. Cl. ..... 2/115; 40/586

[58] Field of Search ..... 2/115, 49 R, 48, DIG. 7; 40/126 R, 108

[56] References Cited

U.S. PATENT DOCUMENTS

| | | | |
|---|---|---|---|
| 1,113,977 | 10/1914 | Freedman | 2/108 |
| 2,437,223 | 3/1948 | Dutrow | 2/94 |
| 3,155,985 | 11/1964 | Gallagher | 2/115 |

*Primary Examiner*—Doris L. Troutman

*Attorney, Agent, or Firm*—Thomas M. Farrell

[57] ABSTRACT

An athletic jersey has a body portion with differing first and second panels at the front and rear respectively. A flap is attached to the body portion and movable over the head of the wearer to first and second positions on the body portions. The flap has differing first and second panels corresponding to the first and second body panels so that in a first position on the body the jersey presents a first appearance for identification purposes and, thereafter as the flap is transposed to the second portion on the body the jersey presents a second appearance for identification purposes. Snap fastener elements are provided to secure the flap in the selected position on the body portion.

4 Claims, 5 Drawing Figures

REVERSIBLE ATHLETIC JERSEY

BACKGROUND OF THE INVENTION

In the field of athletic team sports, it is frequently necessary and desirable that a reversible feature be provided to athletic jerseys. In practice, it is well-known to divide the members of a team into "red" and '37 white" teams for scrimmage purposes. The reversible jersey of the prior art consists of a shirt having differing internal and external surfaces wherein the player turns the shirt inside-out to present a different appearance. The prior art jersey, however, is primarily useful only by male sportsplayers, and female users of the prior art jersey must go to a locker area to change. In the many hours of practice which is required for team sports, the resultant time loss for female players is considerable when reverse jersey appearances are required.

Applicant has obviated the problems inherent in the prior art by a novel design jersey which does not require removal from the player's body during practice or games, wherein both male and female team players may benefit from the resultant time savings when reversing jersey identification is required.

It is therefore an object of the present invention to provide an inexpensive reversible athletic jersey.

Another object of the present invention is to provide a time-saving reversible athletic jersey.

Still another object of the present invention is to provide an athletic jersey which need not be removed from a player when reversing identification of same.

SUMMARY OF THE INVENTION

The invention herein is shown embodied in a reversible athletic jersey, which has a body portion having first and second body panels in the front and rear respectively, which are different in appearance. The flap element is attached to the body portion and movable over the head of the wearer between first and second positions on the body portion, wherein the first flap panel is closely identified with the first body panel and a second flap panel is closely identified with the second body panel. The flap is secured by fastener means at the first and second positions on the body so that the jersey appearance presented by the first flap and body panels is substantially different from the jersey appearance presented by the second flap and body panels.

DESCRIPTION OF THE PREFERRED EMBODIMENT

Figure 1:
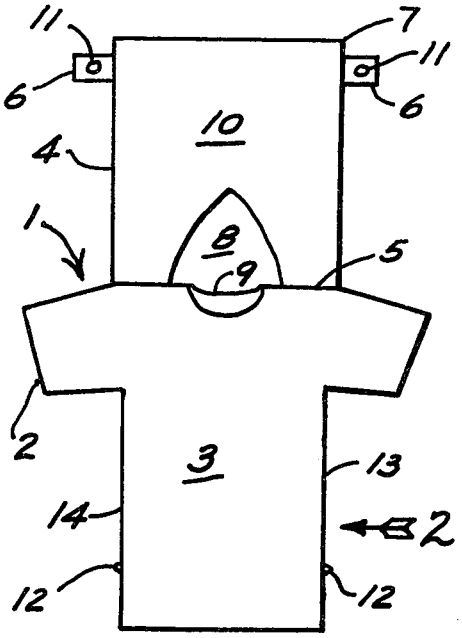
FIG. 1 is a front view of a reversible athletic jersey.

Referring now to the drawings and particularly to FIG. 1 thereof, there is shown a reversible athletic jersey 1 having a body portion 2 generally of "T-shirt" design. The body portion 2 has a first body panel 3 presenting a first identifying appearance to the viewer. A flap element 4 is attached to the body portion 2 at the shoulder line 5. The flap 4 is generally rectangular in shape extending from the shoulder line 5, and tabs 6 are provided on the flap 4 at the distal portion 7 of the extending flap 4. A triangular-shaped aperture 8 having a base at the neck section 9 of the body portion 2 is formed by the body portion 2 and flap 4. The triangular aperture 8 provides clearance for the head of a wearer when the flap 4 is alternately located and relocated. A first flap panel 10 provides an identification means which is substantially identical in character to the first body panel 3.

The tabs 6 of the flap 4 have snap fastener elements 11 located thereon which are well-known in the art. The body portion 2 has snap fastener elements 12 located on the sides 13,14 of the body portion 2 to cooperate with the tab fasteners 11 in manner well-known in the art for securing the tabs 6 to the body portion 2.

Figure 2:
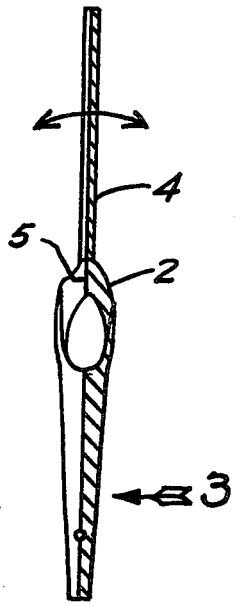
FIG. 2 is a side elevation of a reversible athletic jersey taken in the direction of arrow 2 of FIG. 1.

The side elevation of FIG. 2 depicts the body portion 2 with the flap 4 extending from the shoulder line 5 of the body portion 2. The flap 4 is movable in the direction of the arrows so that it may be alternately located on the body portion 2.

Figure 3:
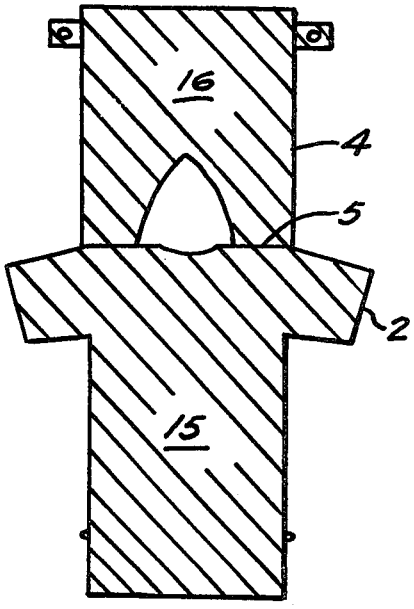
FIG. 3 is a rear view of a reversible athletic jersey taken in the direction of arrow 3 of FIG. 2.

The rear view of FIG. 3 depicts that the body portion 2 has a second, rear body panel 15 of different identification character than the front body panel 3 (the second body panel 15 being cross-hatched to distinguish the appearance). The flap 4 extending from the shoulder line 5 has a second flap panel 16 substantially identical in character to the identification appearance of the second body panel 15.

Figure 4:
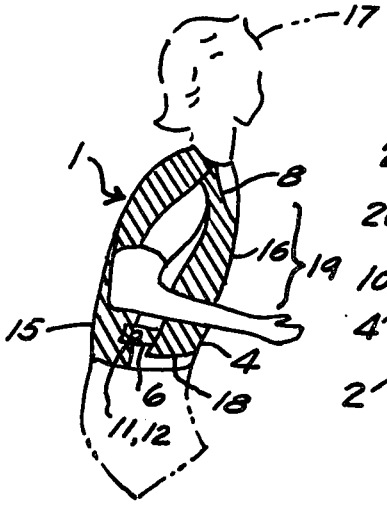
FIG. 4 is a perspective view of a team player wearing a reversible athletic jersey.

FIG. 4 depicts the reversible athletic jersey 1 on a team player 17 wherein the flap 4 is located in a first position 18, at the front 19 of the wearer, and the tab 6 is secured by the snap fastener 11,12 so that an overall identification appearance is presented which substantially corresponds to the identification characteristics of the second body panel 15 and the second flap panel 16.

Figure 5:
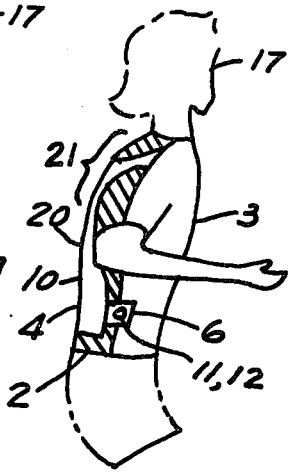
FIG. 5 is a perspective view of the team player of FIG. 4 having jersey identification reversed.

Similarly, FIG. 5 depicts the team player 17 of FIG. 4 immediately after reversing the flap 4 to a second position 20 on the back, or rear 21, of the player 17 wherein the tabs 6 are secured to the body portion 2 by the snap fasteners 11,12 and a second overall identification appearance is achieved which is substantially identical in character to the identification characteristics of the first body panel 3 and the first flap panel 10.

Here it should be noted that alternate forms of identification may be used, for example: identifying indicia such as numbers; names; colors; advertising legends, etc.

It is not intended that the invention be restricted to the specific embodiment shown, but rather the invention comprises all such designs and modifications as come within the scope of the appended claims.

What is claimed is:

1. A reversible athletic jersey, comprising in combination:

(a) a body portion;

(b) a first body panel in the front of said body portion;

(c) a second body panel in the rear of said body portion;

(d) a flap element attached to said body portion and movable between exposed front and rear positions on said body portion while so attached and while said jersey is worn;

(e) a first flap panel associated with said first body panel by first identification means; and (f) a second flap panel associated with said second body panel by second identification means.

2. The athletic jersey of claim 1, further comprising a head clearance aperture formed by said flap and said body portion.

3. The athletic jersey of claim 1, further comprising means to secure said flap at said front and rear positions on said body portion.

4. The athletic jersey of claim 3, wherein said means to secure said flap comprises a snap fastener.

* * * * *